United States Patent [19]

Williamson et al.

[11] Patent Number: 4,840,771

[45] Date of Patent: Jun. 20, 1989

[54] INCUBATOR FOR REAGENTS

[75] Inventors: Edward Williamson, Dover; Stanley Pfeiffer, Mendham, both of N.J.

[73] Assignee: Becton Dickinson & Company, Franklin Lakes, N.J.

[21] Appl. No.: 910,125

[22] Filed: Sep. 22, 1986

[51] Int. Cl.[4] ..... B01L 7/00; B01L 9/00; B01L 11/00

[52] U.S. Cl. ..... 422/104; 422/99; 422/116; 422/300; 422/303; 435/287; 435/289; 435/300; 435/312; 435/809; 200/61; 211/74; 219/430; 219/433; 236/3; 236/2

[58] Field of Search ..... 422/56, 73, 99, 104, 422/116, 300, 303, 68, 63, 64, 65; 435/287, 289, 290, 291, 292, 296, 300, 312, 316, 809; 211/74; 414/419, 421; 200/61

[56] References Cited

U.S. PATENT DOCUMENTS

| | | | |
|---|---|---|---|
| 1,043,561 | 11/1912 | Ayer | 219/433 |
| 2,031,019 | 2/1936 | Walker et al. | 219/433 |
| 2,119,172 | 5/1938 | Madden | 219/433 |
| 2,556,495 | 6/1951 | Freedman | 422/300 |
| 2,835,398 | 5/1958 | Temple et al. | 414/421 |
| 3,109,084 | 10/1963 | Walsh | 219/433 |
| 3,109,531 | 11/1963 | Jackson | 414/419 |
| 3,419,346 | 12/1968 | Nicholas | 422/116 |
| 3,801,467 | 4/1974 | Nobe et al. | 435/809 |
| 3,832,532 | 8/1974 | Praglin et al. | 435/809 |
| 3,843,323 | 10/1974 | Quame | 422/68 |
| 4,011,048 | 3/1977 | Johnson, Jr. et al. | 422/63 |
| 4,173,925 | 11/1979 | Leon | 219/433 |
| 4,260,581 | 4/1981 | Sakurada | 422/65 |
| 4,265,855 | 5/1981 | Mandle et al. | 422/63 |
| 4,269,803 | 5/1981 | Jessop | 422/63 |
| 4,363,782 | 12/1982 | Yamashita | 422/67 |
| 4,512,952 | 4/1985 | Blanding et al. | 422/63 |

*Primary Examiner*—Michael S. Marcus
*Assistant Examiner*—Timothy M. McMahon
*Attorney, Agent, or Firm*—Raymond J. Lillie; Elliot M. Olstein

[57] ABSTRACT

An incubation apparatus containing a rack or block with openings capable of receiving containers containing reagents. The rack or block is attached to a heating element for heating containers in the block. The block is driven by a motor actuated by a timer such that at the end of a predetermined time period the block is pivoted whereby containers will fall out of the block and onto a sloping surface on the housing of the incubator. This apparatus provides for the carrying out of reactions for a predetermined amount of time without the necessity of close monitoring of the incubation by laboratory personnel.

13 Claims, 6 Drawing Sheets

INCUBATOR FOR REAGENTS

This invention relates to incubators for various substances and more particularly to an incubator useful in performing immunoassays. Incubators are generally used for maintaining one or more materials at a certain temperature for a certain amount of time. For example, in an immunoassay, reagents employed in the assay are maintained at a selected temperature for a selected time in accomplishing the immunochemical reactions involved in the assay. In such an assay, a tube or cuvette is left in the incubator for a specific amount of time and at a specific temperature as determined by the protocol for the assay.

The above incubation process and others similar to it require careful monitoring on the part of laboratory personnel. Because incubation processes are done under specific time constraints, laboratory personnel must constantly be aware of the time constraints so that they can stop the incubation process at the proper time. Even in the case of incubators with timing mechanisms which alert laboratory personnel as to when the incubation period is ended, one must still be located somewhere in proximity to the incubator, to be alerted by the mechanism. Accordingly, there is a risk that the materials will continue to be heated well past the prescribed incubation time. In an immunoassay, this may result in inaccuracies in the test results.

In incubators in which the heater is automatically shut off at the end of the prescribed incubation time, it is still necessary to remove the test tube from the incubator in that the contents will contine to be heated by retained heat after the heating element is turned off, which may also introduce inaccuracies into the test results.

In accordance with the present invention, there is provided an incubation device which can be set for a predetermined amount of time, and at the end of the time period, the container containing the materials being incubated is automatically safely removed from the heating portion of the incubator.

In accordance with a particularly preferred embodiment, the container containing the materials being incubated is automatically removed from the heating portion of the incubator in a manner such that after removal, the container is automatically inverted whereby the contents of the container upon being removed from the heating portion, are moved to a different portion of the container.

Still more particularly, there is provided an incubator which includes a housing; a support means for at least one container, such as a block or rack having one or more openings for one or more containers for a material(s) to be incubated, such as test tubes; a heating means for heating a container or containers in the support means; a drive means for moving the support means to a position at which a container or containers in the support means is spilled out of the support means to stop heating of the container; and control means for automatically activating the drive means after a pre-set time to move the support means to a position at which the container spills out of the support means.

Still more particularly, the support means is rotatably mounted for movement between a first position in which a container or containers being incubated in the support means are maintained in the support means to a second position at which the support means is positioned angularly downwardly to spill the containers out of the support means onto a receiving surface on which the containers are no longer subjected to heating.

In accordance with a preferred embodiment, the receiving surface is downwardly sloped whereby the containers upon spilling out of the support means are automatically inverted. In this manner, material within the container may be positioned in one portion of the container during incubation and in a different portion of the container when the container is automatically removed from the support means in which it is being incubated.

In a particularly preferred embodiment, the heating means is maintained in operation during the entire cycle, whereby incubation of the container contents is stopped without shutting down of the heating element.

BRIEF DESCRIPTION OF THE DRAWINGS

Referring to FIG. 1, the incubator 10 which is a preferred embodiment of the invention comprises a housing 11 in which is mounted a rack or block 12 containing a plurality of openings 14. Each opening is adapted to receive a container such as a test tube or similar tubular receptacle 40. Also, on the housing is a control means which in the preferred embodiment includes a timer 16 and a switch 18 which activates a heating means, such as an electrcally powered heating element 20 attached to the block 12. The heating element 20 is protected by insulating material 22, as shown in the cut-away view of the block 12. In front of the block is a surface 24 sloping downwardly from the block 12 to the front of the housing 11. In the preferred embodiment, this surface has curved grooves 26, each curved groove capable of receiving a container such as a test tube when said containers are spilled from block 12 as shown in FIG. 2.

Referring now to FIGS. 1, 2, 3, 5 and 6, it is shown that block 12 is capable of being pivoted about an axis to a position at which the containers such as test tubes 40 spill out onto the sloping surface 24. The block 12 is connected to a driving mechanism by a suitable securing means such as a pin 28. In the preferred embodiment, the pin is journaled through a bearing 29. The driving mechanism, shown in FIGS. 3 and 5, includes a motor 30 which rotatably drives a cam 32 through a suitable drive mechanism (not shown) of a type known in the art. In a preferred embodiment the cam 32 is connected to the motor by means of a shaft 31. Attached to the cam 32 is a means for linking cam 32 to block 12. In the preferred embodiment, the linking means is in the form of arms 34 and 36. Arm 36 is connected to block 12 through pin 28. The connection linking the cam 32, with the linking means 34, and linking means 34 with linking means 36 can be by means similar to pin 28 or any other acceptable connecting or pivoting means known in the art. FIG. 3 shows the connection of the cam 32 to arm 34 by means of pin 33, and the connection of arm 34 to arm 36 by pin 35. It is also shown that pin 28 fits between two forks of a bifurcation in arm 36. The pin 28 is secured in the bifurcation by means of a tightening screw 37 inserted through the two forks of the bifurcation. The function of these arms 34 and 36 is to link the cam 32 to the block 12, so that when the cam 32 is rotated by the activation of the motor 30, the cam moves the arms 34 and 36 in such a way that the arms 34 and 36 are able to pivot the block 12 to a downwardly inclined position and thereafter back to an upright position.

Figures 3, 4:
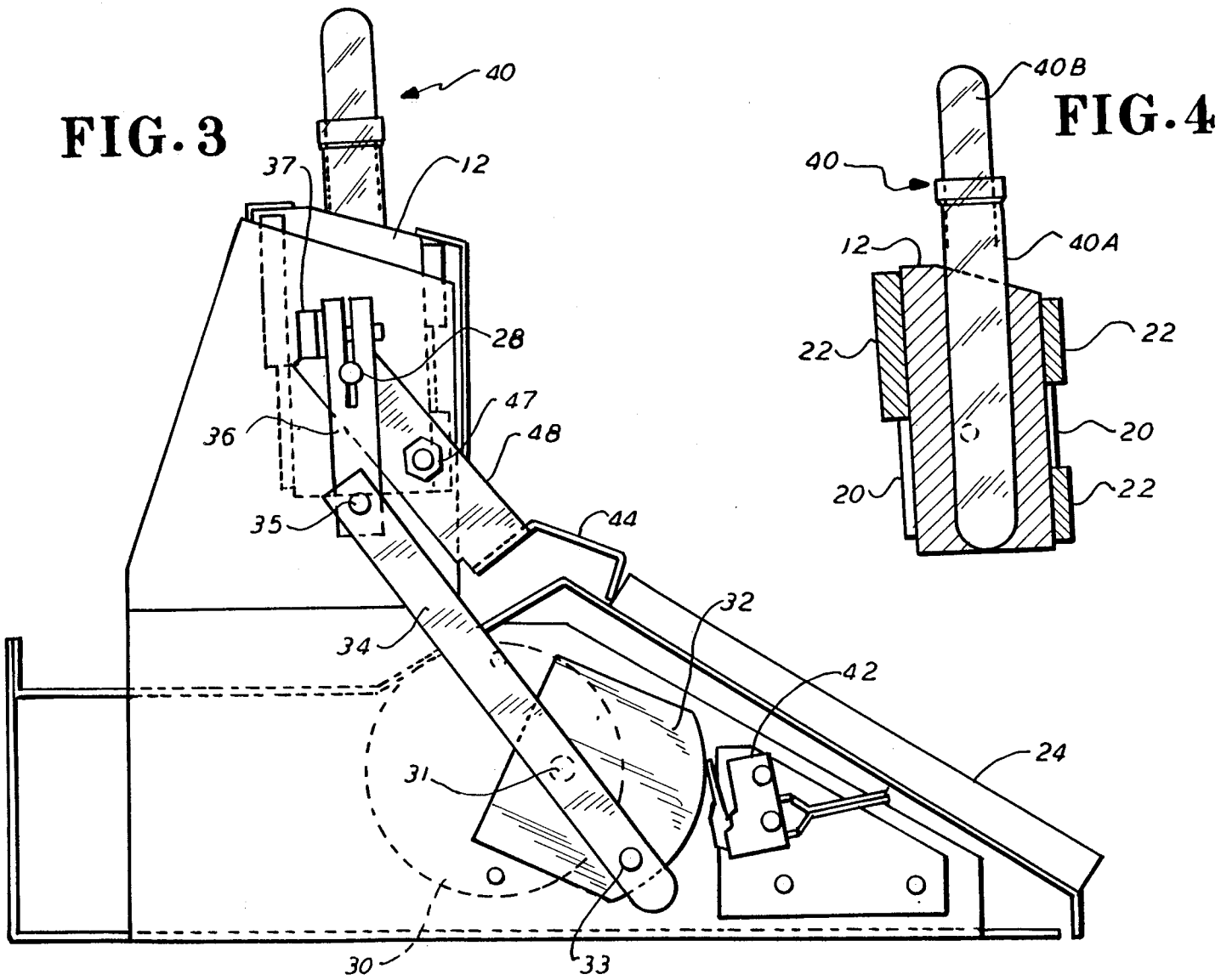
FIG. 3 is a cut-away side view of the incubator showing the driving mechanism which rotates the block.
FIG. 4 is a cut-away side view of the block showing a test tube within the block.

As can be seen in FIG. 3, the cam 32 contacts a switch 42. Contact between the cam 32 and switch 42 keeps the switch 42 open which prevents operation of motor 30, thereby also preventing rotation of cam 32. Switch 42 however, is overriden by the timer 16, which activates the motor 30, to rotate cam 32. The timer 16 overrides the switch 42 and actuates the motor 30 at the end of a pre-set time period.

Figure 1:
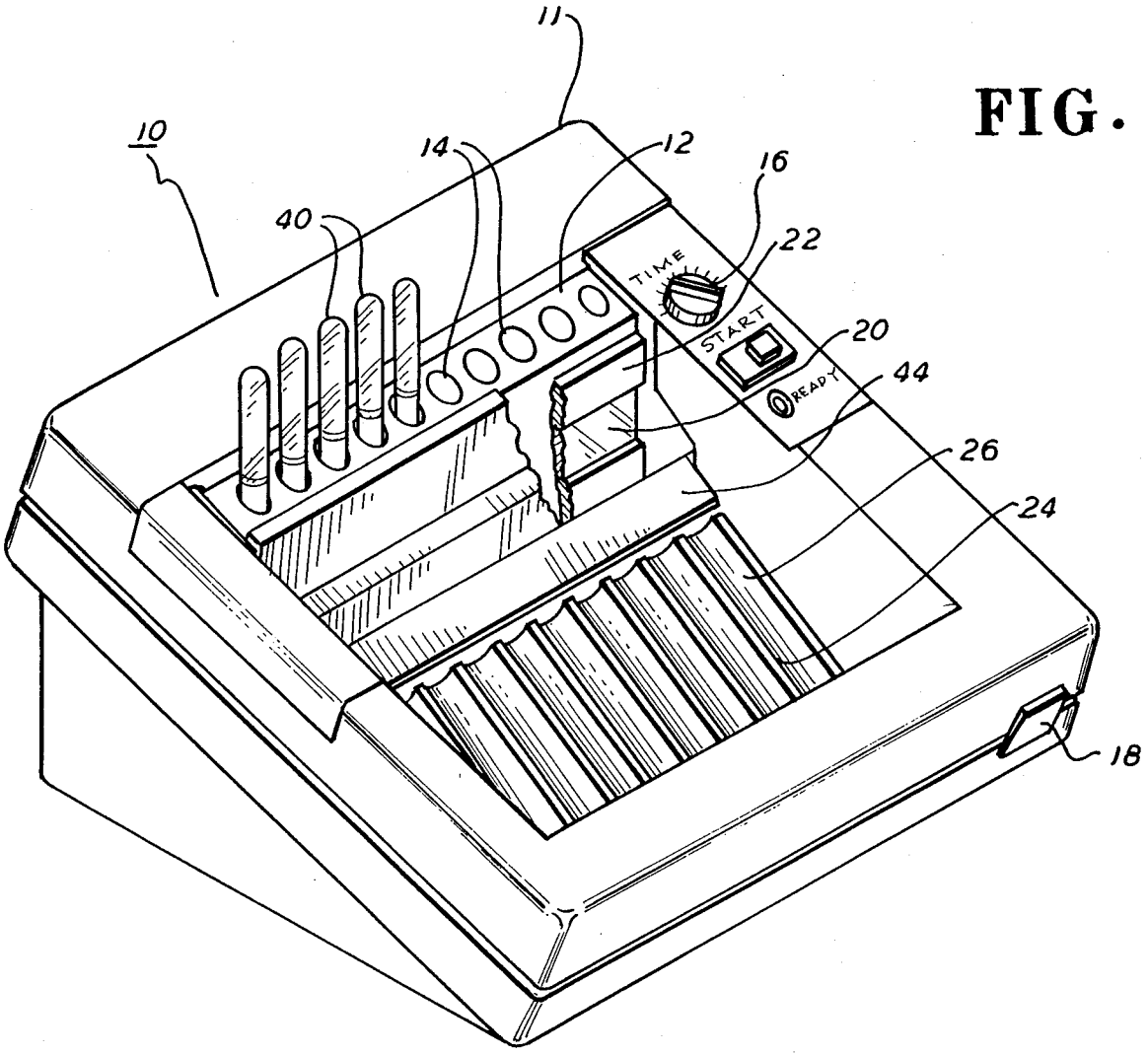
FIG. 1 is a front isometric view of an embodiment of the incubator of the present invention.
Figure 2:
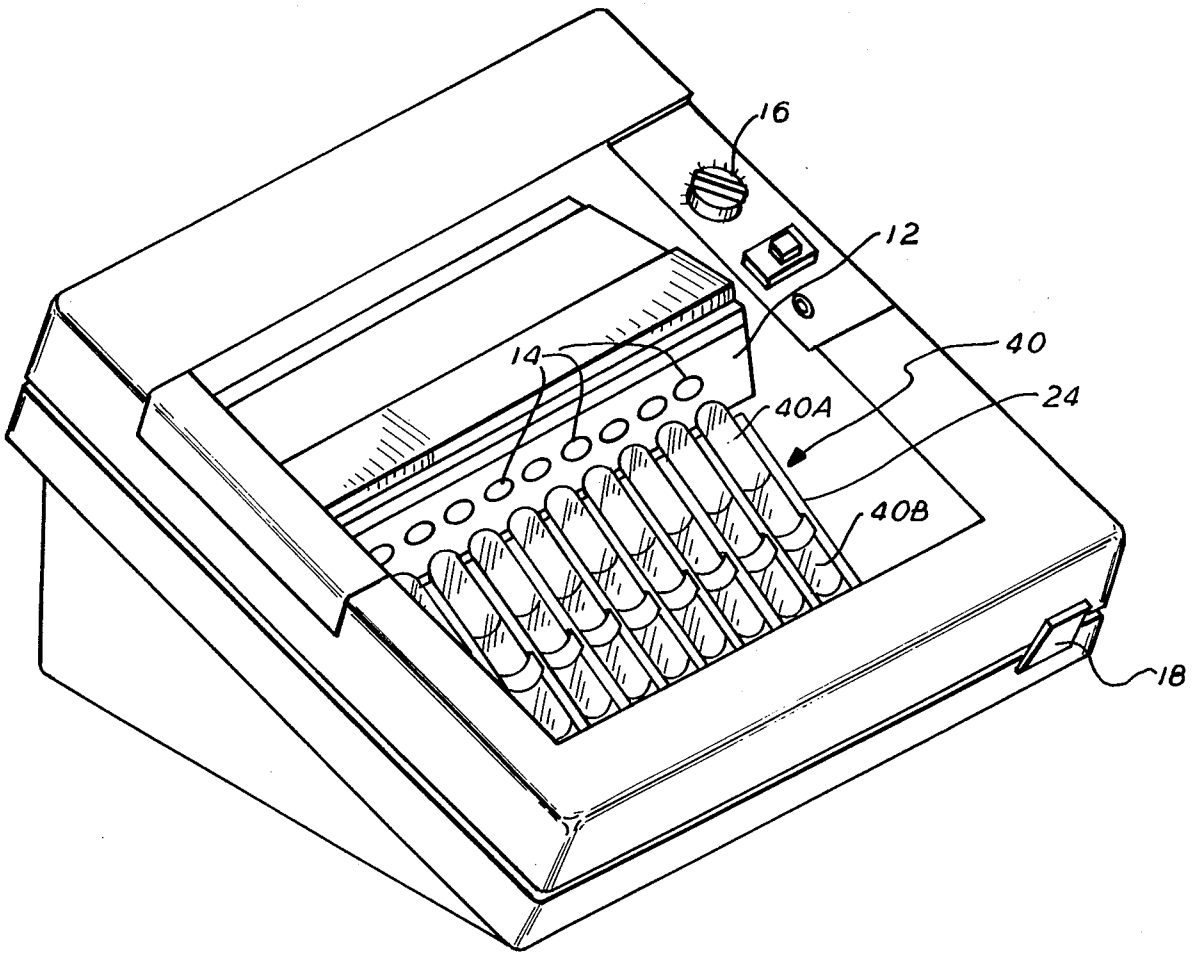
FIG. 2 is a front isometric view of the embodiment shown in FIG. 1 showing the test tubes which have been spilled out of the block.
Figure 5:
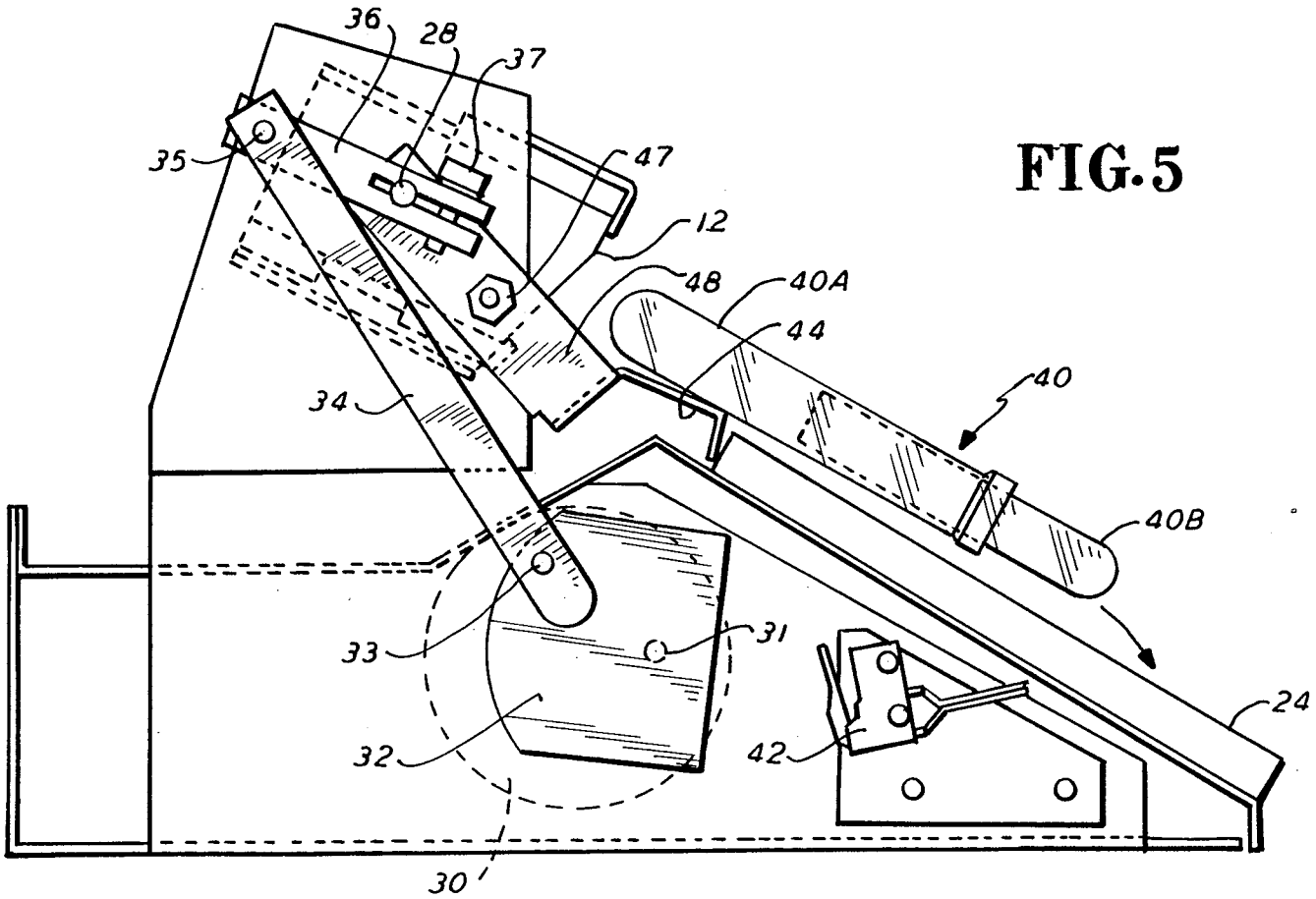
FIG. 5 is a cut-away side view of the driving mechanism of the incubator, showing a test tube being spilled out of the block.
Figure 6:
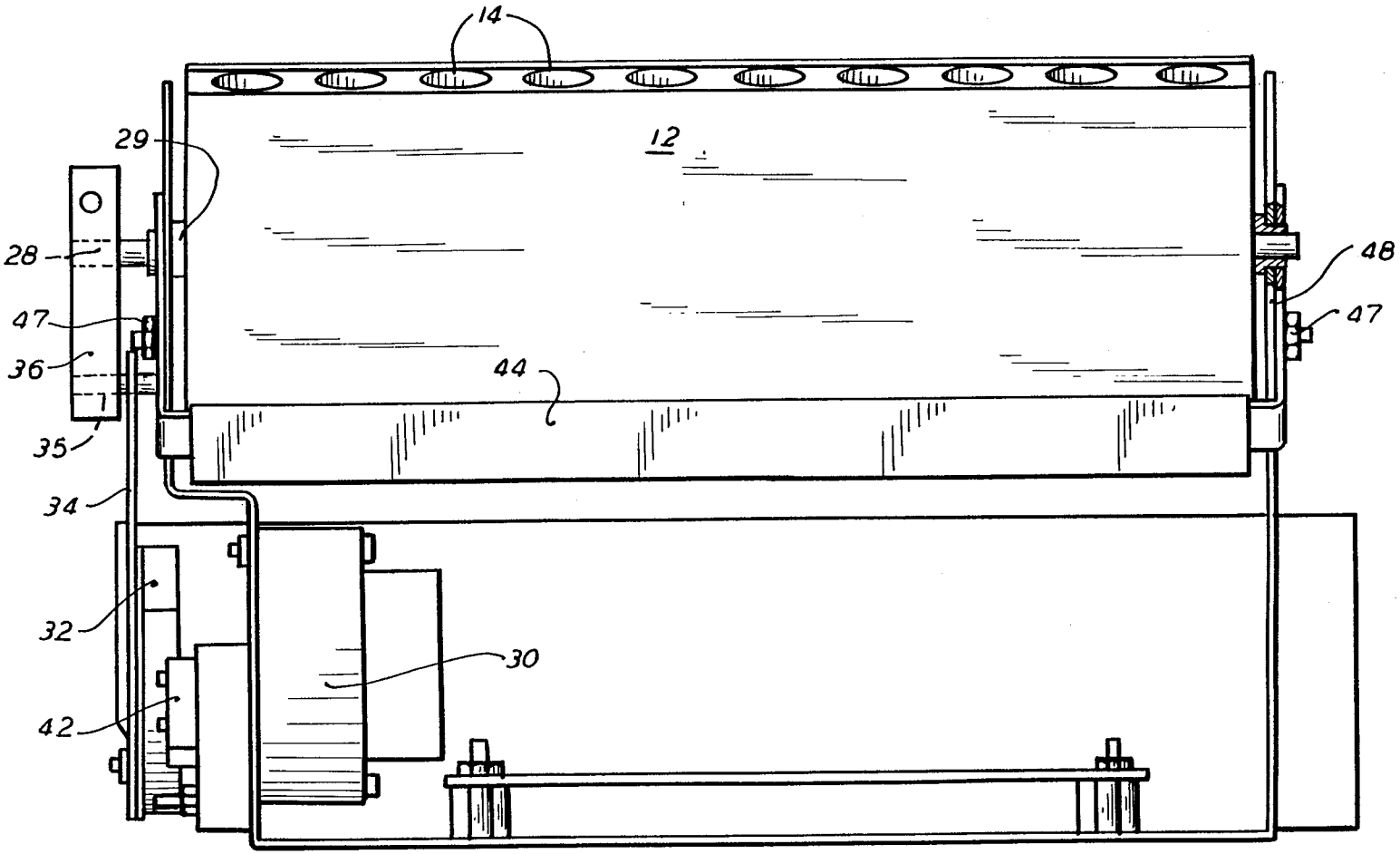
FIG. 6 is a cut-away front plan view of the incubator showing the drive mechanism.

As shown in FIG. 1, 3 and 5 the preferred embodiment shows a ramp 44 between the block 12 and the top of the downwardly sloping surface 24. The ramp 44 raises the containers slightly as they are spilled out of the block 12 so that there is less area of contact between the container and the walls of the openings 14 in block 12. This lessens the frictional force between the containers and the walls of the openings 14 of block 12 so that the containers are more easily spilled out of the block 12 onto surface 24. FIGS. 3 and 5 show that the ramp 44 is connected with the housing by means of a bracket connector 48. The location of the ramp can be adjusted by turning a nut 47 that holds the connector 48 to the housing.

Figure 7:
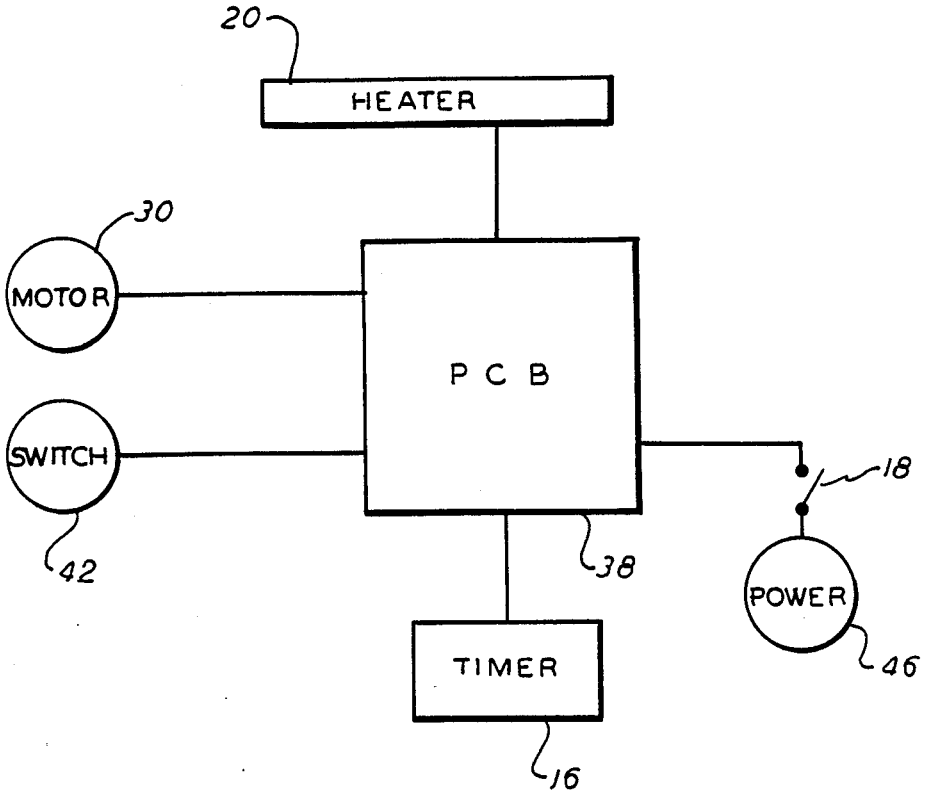
FIG. 7 is a schematic drawing of the electrical connections within the incubator.

As above stated, the motor 30 is actuated by the timer 16, which is connected in series to the motor 30 in the preferred embodiment by means of a printed circuit board 38 as shown in FIG. 7. The timer 16 is set for a predetermined period of incubation after the containers, which in the preferred embodiment are in the form of test tubes 40, are placed in openings 14 in block 12. The containers, when placed in the block, are completely closed and have no openings exposing their contents to outside air. At the end of the predetermined incubation period, the timer 16 overrides switch 42 which has remained open, and actuates the motor 30. The motor 30 in turn rotates the cam 32 which by means of its rotation moves away from switch 42, thereby closing the switch 42. The cam 32 also moves arm 34, which in turn moves arm 36. The movement of arms 34 and 36 by the cam 32 serves to pivot block 12 to a position angularly downwardly whereby the tubes 40 are spilled out of the openings 14 of block 12, and in the preferred embodiment, onto ramp 44 which guides the tubes 40 out of openings 14 and into grooves 26 of sloping surface 24. To ease further the transfer of the tubes 40 from the block 12 to surface 24, the ramp as well as the block 12 and openings 14 are coated with a low friction substance. During the operation of the motor 30 as shown, the cam 33 makes on complete rotation. At the end of this rotation the block 12 is returned to its upright position and the cam 32 contacts switch 42 to reopen switch 42 and deactivate motor 30.

Referring again to the schematic shown in FIG. 7, in the preferred embodiment it is shown that timer 16, motor 30, heater 20 and switch 42 are all connected to printed circuit board 38. It has been stated that the timer 16, connected in series to motor 30 through circuit board 38 activates motor 30 by overriding switch 42. When the cam 32 of motor 30 makes one complete revolution, it contacts switch 42, thereby opening the switch which shuts off the motor 30. Thus, the timer 16 functions to start the motor 30 after a set period of time, and switch 42 functions to stop motor 30 after the block 12 has been pivoted to an inclined position to spill containers 40 out of the block 12 and thereafter returned to its upright position. It is also shown that heater 20 is connected by means of a switch 18 to a source of power 46. This source 46 is also connected to circuit board 38. When switch 18 is closed, the heater 20 draws power from source 46 and is able to heat the block 12. This connection which activates heater 20 can occur independently of the connection of timer 16 with motor 30. Thus, heater 20 can remain activated whether or not the timer 16 and/or the motor 30 are activated or deactivated, whereby the heater 20 can work continously even though the timer 16 is not in operation or even after the end of a pre-set time period which was set on the timer. The practical advantage is that the heater can run continuously and there is no need for one to wait for the incubator to "warm up" when one wants to do an incubation using this invention. The schematic shown in FIG. 7 is a preferred embodiment of the circuitry of the invention. Other embodiments of the circuit as described are within the spirit and scope of the invention.

In a preferred embodiment, as shown in FIGS. 1, 2, 4 and 5, the container are in the form of test tubes 40 consisting of one test tube 40A in the standard upright position and another test tube 40B of a lesser diameter than test tube 40A. Test tube 40B is inverted and its opening fits snugly inside the opening of test tube 40A. This embodiment is particularly useful in antigen-antibody reactions wherein for example an analyte and tracer are incubated with a binder such as an antibody coated on the walls of the tube 40A. An analyte and tracer in test tube 40B are poured into rest tube 40A and test tube 40B is inverted and placed inside test tube 40A, forming tube 40 which is placed in block 12 wherein the antigen and antibody are incubated. The analyte and tracer will be separated immediately from the antibody or binder coated on the walls of the tubes 40A when tube 40 is spilled out of block 12 as the bottom of tube 40B will be pointing at an acute angle downwardly from the horizontal and any remaining substance originally poured from test tube 40B into the test tube 40A will gravitate back into tube 40B. Any antigen-antibody complexes that were formed during incubation will remain in tube 40A and can then be assayed. The advantage in this procedure is that the solid and liquid reactants are separated immediately upon completion of the incubation period as opposed to having to wait for a laboratory technician to come to the incubator and remove the tubes and separate the reactants. The incubator of the present invention therefore lends itself to obtaining more accurate immunological assay determinations.

Although specific embodiments of this invention have been shown, the invention is not intended to be limited to these embodiments. For example, the driving mechanism is not intended to be limited to the embodiment shown. Any mechanism capable of pivoting the block 12 can be used in accordance with the invention. Also, this invention may be used for reactions other than immunoassays. It can be used for other chemical and biochemical processes and could be used for growing anaerobic organisms. The containers to be used in the incubation are not to be limited to tube 40 consisting of test tubes 40A and 40B. Other closed containers may be used in the incubation. For example, stoppered test tubes or other containers may be used in accordance with this invention. Also, the openings 14 in the block are not to be limited to the circular openings shown in the drawing.

What is claimed is:

1. An apparatus for heating at least one container, said apparatus comprising:

a housing;

a block including a plurality of openings for holding containers;

means for pivotably securing the block to said housing, whereby the block is pivotable between an upright position in which containers are supported in the block and a downwardly inclined position in which containers spill out of the block;

drive means drivingly connected to said block to pivotably move the block from an upright position to a downwardly inclined position and back to an upright position;

heating means for heating containers in the block; and control means for automatically actuating said drive means after a pre-set time to pivot said block to said downwardly inclined position, whereby containers automatically spill out of the block and heating of containers is stopped without shutting down of the heating means.

2. The incubator of claim 1 wherein said heating means is attached to said block.

3. The apparatus of claim 1 wherein said control means comprises:

a circuit board;

a timer;

a switch for actuating a motor, with said timer, said circuit board, and said motor being connected in series, and wherein said switch is normally in an open position, thereby preventing actuation of said motor and said timer is capable of being set for a pre-set time period, and said timer capable of overriding said switch at the end of said pre-set time period, thereby actuating said motor.

4. The apparatus of claim 1 wherein said drive means comprises:

a motor;

a cam;

a shaft connecting said cam to said motor;

first and second linking means for linking said cam to said block, said first linking means being connected to said cam and to said second linking means, and said second linking means being connected to said block, whereby said block is moved upon actuation of said motor.

5. The incubator of claim 1 wherein the heating means is an electrical heating means, and means to provide power to said heating means independent of the starting and stopping of said drive means.

6. An apparatus for heating at least one container, said apparatus comprising:

a housing;

a block including at least one opening for holding at least one container having a top portion and a bottom portion;

means for pivotably securing the block to said housing, whereby the block is pivotable between an upright position in which a container is supported in the block, and a downwardly inclined position in which a container spills out of the block;

drive means drivingly connected to said block to pivotably move the block from an upright position to a downwardly inclined position and back to an upright position;

heating means for heating at least one container in the block;

control means for automatically actuating said drive means after a pre-set time to pivot said block to said downwardly inclined position, whereby a container spills out of the block and heating of a container is stopped without shutting down of the heating means;

receiving means adjacent said block for receiving a container when a container is spilled out of said block, said receiving means maintaining a bottom portion of a container at an elevation higher than a top portion of a container upon spilling of a container from said block.

7. The apparatus of claim 6 wherein said receiving means comprises a downwardly sloping surface located in said housing, said surface including a top portion and a bottom portion.

8. The apparatus of claim 7, and further comprising a ramp located between said block and the top portion of said downwardly sloping surface, said ramp being contacted by a container when a container is spilled from said block, and thereby guiding a container from said block to said downwardly sloping surface.

9. The apparatus of claim 7 wherein said downwardly sloping surface contains at least one curved groove for receiving a container upon spilling of a container from said block.

10. An apparatus for heating at least one container, said apparatus comprising:

a housing;

a block including at least one opening for holding at least one container;

means for pivotably securing the block to said housing, whereby the block is pivotable between an upright position in which a container is supported in the block and a downwardly inclined position in which a container spills out of the block;

drive means drivingly connected to said block to pivotably move the block from an upright position to a downwardly inclined position and back to an upright position;

heating means for heating at least one container in the block;

control means for automatically actuating said drive means after a pre-set time to pivot said block to said downwardly inclined position, whereby a container spills out of the block and heating of said container is stopped without shutting down of the heating means; and means for receiving a container when a container is spilled out of said block, said means for receiving a container being located adjacent said block.

11. The apparatus of claim 10 wherein said receiving means comprises a downwardly sloping surface, said downwardly sloping surface including a top portion and a bottom portion.

12. The apparatus of claim 11, and further comprising a ramp located between said block and the top portion of said downwardly sloping surface, said ramp being contacted by a container when a container is spilled from said block, and thereby guiding a container from said block to said downwardly sloping surface.

13. The apparatus of claim 11 wherein said downwardly sloping surface contains at least one curved groove for receiving a container upon spilling of a container from said block.

* * * * *